US005728027A

United States Patent [19]

Sinaiko

[11] Patent Number: 5,728,027

[45] Date of Patent: Mar. 17, 1998

[54] BIOFEEDBACK SYSTEM FOR TRAINING ABDOMINAL MUSCLES

[76] Inventor: Robert J. Sinaiko, 449 Alvarado St., San Francisco, Calif. 94114

[21] Appl. No.: 868,040

[22] Filed: Jun. 3, 1997

Related U.S. Application Data

[63] Continuation of Ser. No. 652,838, May 23, 1996, abandoned.

[51] Int. Cl.[6] ..... A61B 5/103

[52] U.S. Cl. ..... 482/4; 482/1; 482/7; 482/148; 340/573; 73/379.02

[58] Field of Search ..... 482/1–9, 148, 482/900, 909; 340/500, 573, 540, 689; 73/379.01, 379.02, 379.08

[56] References Cited

U.S. PATENT DOCUMENTS 4,007,733 2/1977 Celeste et al. .
4,776,323 10/1988 Spector .
4,846,462 7/1989 Regnier et al. ..... 482/1
5,078,153 1/1992 Nordlander et al. .
5,304,984 4/1994 Roldan ..... 340/573
5,522,401 6/1996 Brucker ..... 482/148

OTHER PUBLICATIONS

Clear Sky Products Brochure "Spine Tuner".

*Primary Examiner*—Richard J. Apley
*Assistant Examiner*—Glenn E. Richman
*Attorney, Agent, or Firm*—Flehr Hohbach Test Albritton & Herbert

[57] ABSTRACT

A biofeedback system for training the abdominal muscles uses a belt or waistband with a buckle which includes switches, at least one switch modifying a music tape source which is, for example, mounted on the belt. The belt buckle is expandable so that with the abdominal muscles (abs) relaxed, a switch will be in one position, and with the abs tensed, it will be in another, to appropriately modify the sound source. This is fed back to the user via the headphones so that when he recognized the modification the user will be encouraged to re-tense the abs.

3 Claims, 3 Drawing Sheets

BIOFEEDBACK SYSTEM FOR TRAINING ABDOMINAL MUSCLES

This is a continuation of application Ser. No. 08/652,838, filed May 23, 1996, now abandoned.

The present invention is directed to a biofeedback system for training abdominal muscles and more particularly to a waistband having an expandable buckle for modifying an audio source for providing feedback.

BACKGROUND OF THE INVENTION

Biofeedback techniques have been used on human beings as for example shown by U.S. Pat. No. 4,007,733 to Celeste et al. U.S. Pat. No. 5,078,153 to Nordlander and U.S. Pat. No. 4,776,323 to Spector. Nordlander describes an apparatus for prevention of teeth grinding where a piezo-electrically activated transmitter in the user's mouth triggers a remote unit to generate sounds intended to stop the user from grinding his teeth. Spector involves a biofeedback connection with movement of the user's legs or arms during exercise and adjusts the rhythm of an accompanying exercise music track to facilitate rhythmic performance of the exercise. Finally, Celeste is a posture training device having adjustable shoulder straps. A sensory stimulus is applied to the user when the tension of the strap is relaxed.

There is no known practical biofeedback system for training abdominal muscles.

OBJECT AND SUMMARY OF THE INVENTION

It is a general object to the present to provide a biofeedback system for training abdominal muscles.

In accordance with the above invention there is provided a biofeedback device for training a person's abdominal muscles by contraction and relaxation comprising a waistband for placement around the person's waist having expandable buckle means for fastening together the ends of the waistband and for sensing contraction or expansion of the waist caused by the tensing or relaxation of the abdominal muscles. An audio source having headphones is carryable by the person. The buckle means include at least one switch means connected between the headphones and audio source and activated by the expansion or contraction of the waist for modifying the audio output of the audio source as heard on the headphones by the person. In response to this activation of the switch means feedback as to the state of the abdominal muscles is given to the person.

DETAILED DESCRIPTION OF PREFERRED EMBODIMENTS

Figure 1:
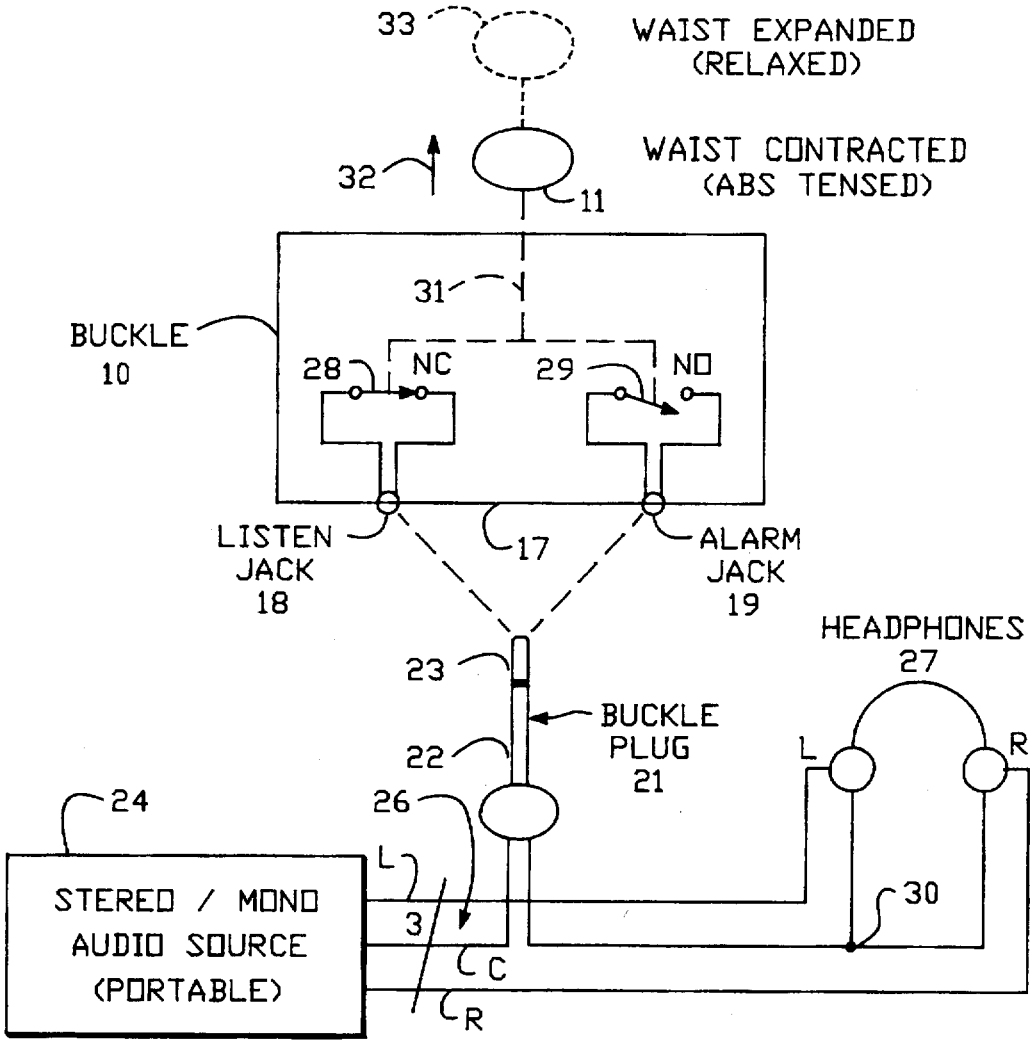
FIG. 1 is a block diagram with accompanying simplified circuitry embodying the present invention.
Figure 3:
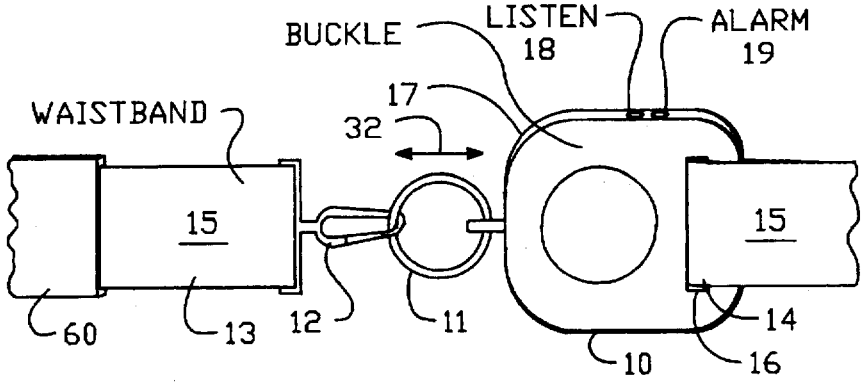
FIG. 3 is a simplified plan view of the portion of the system of the present invention that would be placed around the waist of a person wearing the device.

FIG. 1 illustrates the overall biofeedback system of the present and includes a buckle 10 which connects the ends of a waistband or belt worn by the person who is using the exercise device. The buckle has a ring 11 extending from it to which a catch on the end of the waistband is clipped. FIG. 3 illustrates the foregoing where the buckle 10 and the ring 11 is clipped at 12 to the end 13 of the waistband 15. The other end 14 of the waistband is wrapped through a hole 16 in the buckle. The buckle includes on its top edge 17 a listen jack 18 an alarm jack 19.

Referring back to FIG. 1, jacks 18 and 19 will alternately receive (depending on the choice of the user) a buckle plug 21. This is a standard radio-type plug having an electrically separated main portion 22 and a tip portion 23. A portable audio sound source 24 (which for example might be a combined FM/AM radio receiver and a tape player sold under the trademark Sony Corporation WALKMAN®) provides stereo FM or an audio voice or music tape or alternatively monaural by way of a monaural tape or an AM radio station. Audio source 24 has an output jack into which may be inserted a three conductor cable shown at 26 having wires designated respectively left (L), right (R), and common (C). In normal use, this cable 26 is connected to a pair of headphones 27 which are wearable on the head of the person using the system having left and right earphones labeled L and R. The L and R wires are respectively connected to the earphones and the common to both earphones.

Interrupting the C conductor and in series with it, is the buckle plug 21. At the option of the user this buckle plug is plugged into either the jack 18 where the normally closed (NC) switch 28 completes the circuit to provide for ordinary stereo music listening or to the alarm jack 19 where the normally open (NO) switch 29 interrupts the circuit. Switches 28 and 29 are mechanically connected as illustrated by the dashed line 31 to the ring 11 which is spring-biased (as will be discussed below) in the solid line position indicated so that the switches 28 and 29 are in the normal positions indicated. However, when the ring is pulled out in the direction of the arrow 32 to the new position 33, switch 28 will then be opened and switch 29 will be closed.

Figure 4:
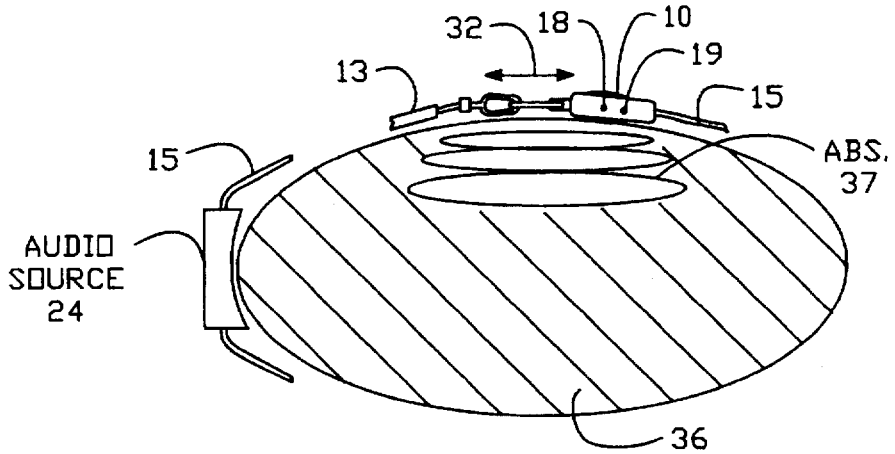
FIG. 4 is a cross-sectional view showing the components of FIG. 3 as they would be installed on the waist of a person wearing the device.

Referring briefly to FIG. 3, the ring 11 is shown with the arrow 32 indicating its direction of movement which of course is a linear in-and-out movement from the buckle 10. In use, the waistband 15 is placed around the waist of the person using the device as illustrated in FIG. 4, in front of the abdominal muscles in the torso of the human body, indicated as a cross-section at 36, and in proximity to the abdominal muscles 37 designated "abs." If desired the audio source 24 is conveniently mounted as illustrated to the side on the belt or waistband 15.

Since ring 11 is spring biased to tension the waistband as illustrated in FIG. 1 when the waist is contracted with the abs tensed, it will assume the solid line position at 11. When the user relaxes his waist, it will expand and the ring is forced to extend out to the position 33. Thus, the belt buckle and the ring are contracted or expanded because of the connection around the waist of the user caused by the tensing or relaxing of the abs.

Still referring to FIG. 1 and assuming the buckle plug 21 is plugged into listen jack 18, movement of ring 11 will open and close switch 28 to thus modify the musical or audio output of unit 24 as heard by the user at headphones 27. With switch 28 closed, a normal high-quality musical sound is produced at headphones 27. With the switch open, however, the common is interrupted and the left and right channels will tend to cancel each other somewhat producing a lower-quality or "tinny" sound. This thus tells the user that their waist has expanded and, in accordance with the biofeedback technique of the present invention, alerts the user that they should contract the waist by tensing the abs. Thus, one feedback mode of the present invention for the purpose of training the abdominal muscles is to have good quality stereo music with the abs tensed and a poor quality with them relaxed.

Still assuming that listen jack 18 is being used, if a monaural source is present with the listen jack switch 28 closed, good monaural will be heard; but with the switch open, since the monaural input to the left and right headphones is identical, they will cancel because of the common ground connection indicated at 30 thus there will be silence. Here the user is encouraged to tense his abs in order to hear music.

When the buckle plug 21 is plugged into alarm jack 19, the normally open switch 29 provides exactly the opposite effect; that is, with a monaural source there is silence with the switch open since the left and right channels are cancelled. Therefore, with abs tensed the user is "rewarded" with silence.

Thus far music has been described. However, the audio source may have a monaural tape which says "tuck it in . . . tuck it in . . . . " This would normally be used with the alarm jack 19. Thus the reminder will be heard only when the waist is expanded or relaxed (that is switch 29 will be closed to complete the audio circuit). But with the waist contracted, meaning the abs are tensed, switch 29 is open to effectively cancel the output of the monaural source and the "annoying" reminder is silenced. A further modification might include the use of a buzzer or vibratory unit which the switch of the buckle would activate. However, it is believed that a musical biofeedback is psychologically superior. Finally, with appropriate miniaturization the buckle itself or a unit closely associated with it could contain a sound source making headphones unnecessary. But at the present time the very high audio quality of headphones is again psychologically better.

Figure 2:
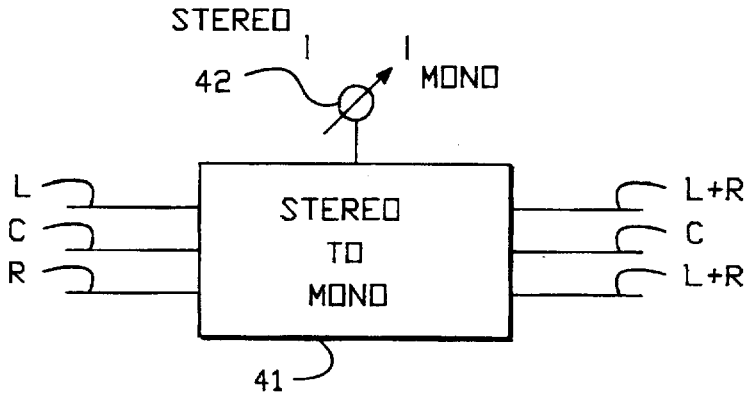
FIG. 2 is a block diagram of an alternative modification of FIG. 1.

FIG. 2 illustrates an added feature where a switchable stereo or monaural adapter unit 41 may be attached to the stereo source 24 to provide by the switch 42 monaural sound from a stereo tape to thus produce two channels of "L+R." These adapters are commercially available.

As illustrated in FIG. 1, the user of the biofeedback system designed in accordance with the present invention could purchase all of the units shown including the stereo or audio sound source 24, the high-quality headphones 27, and the cable 26 with the buckle plug 21, the buckle 10 and the associated waistband 15 shown in FIG. 3. The portable stereo source will already be affixed to the waistband. Alternatively, of course, the user could use their own existing portable stereo source with headphones and merely purchase the rest of the equipment in FIG. 1. It has been found that very high-quality headphones are desirable and thus normally, even if the user had their own stereo source, they would purchase the headphones with the specially configured cable 26 with the buckle plug 21.

Figure 5:
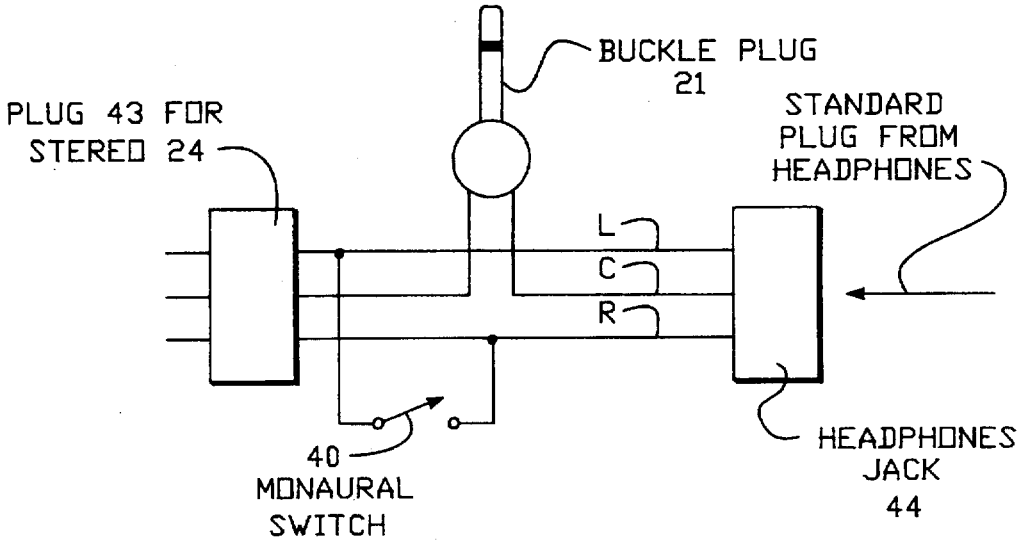
FIG. 5 is a circuit schematic of an alternative connector for FIG. 1.

However, assuming the user wishes to use their own headphones 27 along with their own stereo source 24, then, as illustrated in FIG. 5, a special wiring harness can be used which has a plug 43 for plugging into the audio source 24 and a headphones jack 44. Of course, the common (C) is interrupted by the buckle plug 21. A switch 40 provides monaural in the same manner as the switch of FIG. 2.

Figure 6:
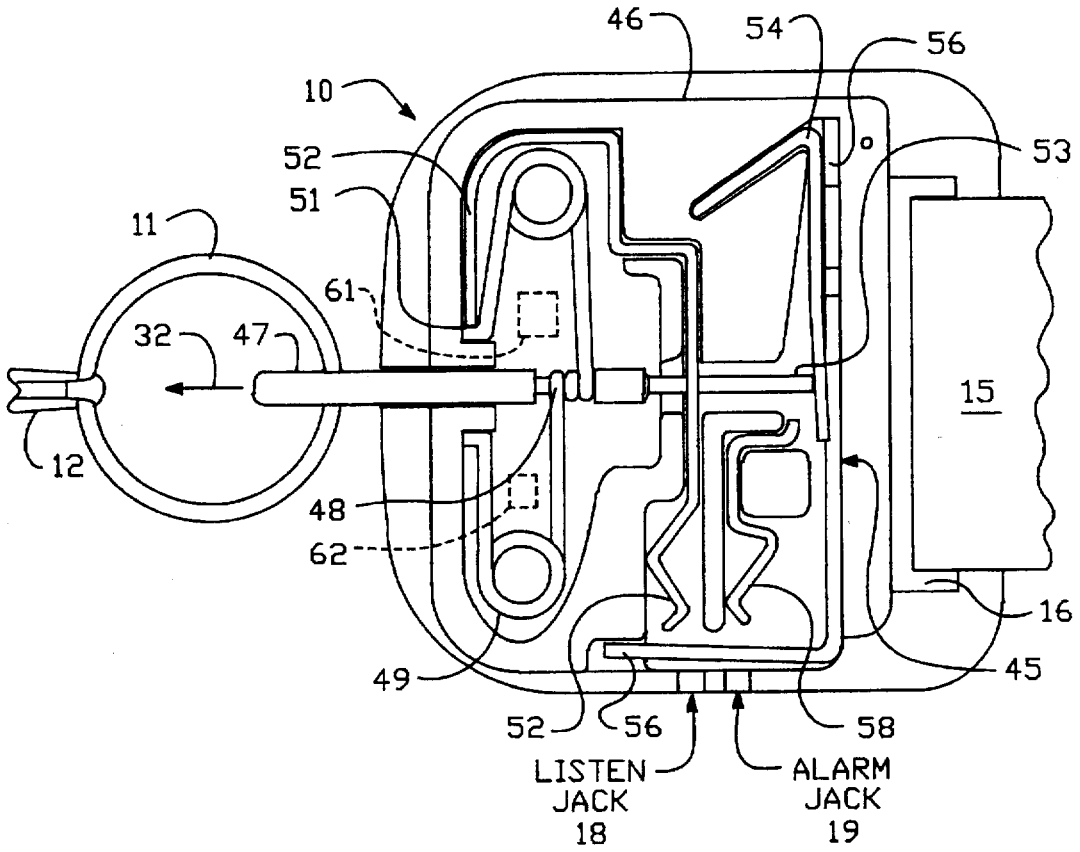
FIG. 6 is a plan view of a buckle portion of FIG. 1 with a cover removed.

FIG. 6 shows buckle 10 with its cover removed. The effective switches 28 and 29 of FIG. 1 are shown in simplified enlarged detail in FIG. 7 and the actual components are shown at 45 in FIG. 6.

Figure 7:
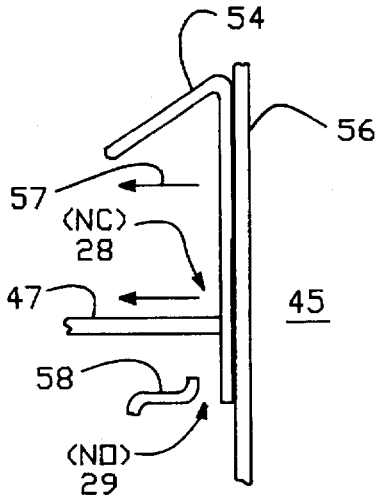
FIG. 7 is an enlarged detail view which is simplified of a switching circuit portion shown in FIG. 6.

Referring to both FIGS. 6 & 7, the buckle 10 is formed of a plastic case 46 which has indentations and recesses in it to hold the several metal parts. Ring 11 is connected to the linear reciprocating shaft 47 and is biased toward the buckle 10 by a piano wire 49 which is wrapped or coiled around the shaft at 48 to also make electrical contact with it. Wire 49 in this context is 0.047 inches in diameter, otherwise known as a standard piano wire size 21. The piano wire, as shown at 49, has safety-pin-like turns in it with the ends of the wire abutting against the walls of the recess of case 46; for example at 51. However, also at this point 51 is a conductor 52 which makes electrical contact at 51 with the spring 49.

Conductor 52 is formed around in the recess back to the listen jack 18 to form the spring-loaded conductor which makes contact with tip portion 23 of the buckle plug 21 (see FIG. 1). Of course, electrical contact is also made at 51 to the spring 49 with the spring 49 making electrical contact with the shaft 47 because of the several turns around the shaft at 48. Then the end of shaft 47, shown at 53, is in contact with the leaf spring 54 which is mounted in a groove in casing 46 as illustrated to cause the leaf spring to be biased against the end of shaft 47. FIG. 7 should also be referred to now.

In the same recess as the leaf spring 54 is the conductor 56 which at both listen jack 18 and alarm jack 19 serves as the electrical connection to portion 22 of buckle plug 21 (see FIG. 1). Wire 56 extends along the recess placing it in continuous contact with at least a portion of the leaf spring 54 (see FIG. 7). The biasing of leaf spring 54 is shown by the arrow 57.

The final electrical contact which serves a switching function is the conductor 58 which is in the recess associated with alarm jack 18 which makes contact with portion 23 of buckle plug 21 when it is inserted in that jack. Only the end of conductor 58 is also shown in FIG. 7. When pin 47 is moved away from leaf spring 54 or out of contact with it, the spring will move forward until it is stopped by the conductor 58 to make alternative electrical contact there. Thus, the end of leaf spring 54 and the conductor 58 form the normally open switch 29 and the shaft 47 and end of leaf spring 54 form normally closed switch 28. The operation of all of the foregoing, of course, is very simply shown in FIG. 1.

In actual use, the spring bias on ring 11 has been set for most male users at approximately five pounds of force. Thus, when the user is installing the waistband around his waist, the waistband will have a cinching adjustment on it, for example shown at 60 in FIG. 3, for producing that tension. This offsets the five pound pull of ring 11 so that with the waist or abs relaxed, the ring 11 will be pulled out, as illustrated, to the dashed position 33 in FIG. 1. The user should then experiment so that when the abs are contracted he will see the ring retract.

To prevent permanent distortion of spring 49, the range of motion of pin 47 is limited by blocks 61 and 62. These are molded into the underside of the cover (not shown) of plastic case 46.

Many varieties of biofeedback have been illustrated, including good-quality music versus poor-quality music, silence or music, and finally spoken coaching instructions. With the variety provided by the two jacks 18 and 19 in FIG. 1, other modes may be possible. In any case, as with any biofeedback exercise device, the present invention has provided the user with an option for the most psychologically useful mode for abdominal exercising while one is walking or running or merely sitting and working.

I claim:

1. A biofeedback system for training a person's abdominal muscles by contraction and relaxation comprising:

a waistband for placement around said person's waist having expandable buckle means for fastening together the ends of said waistband and for sensing contraction or expansion of said waist caused by the tensing or relaxation of said abdominal muscles;

an audio source having a stereo audio output carryable by said person and a pair of headphones wearable by said person and connected to said audio source by left and right stereo channel wires and a common wire which is connected to both headphones by a common ground connection between headphones;

said buckle means including at least one switch means connected to said audio source in series with said common wire and activated between a closed and open condition by said contraction or expansion of said waist for modifying the audio output of said audio source as heard by said person in response to said activation of said switch means, said modification being a lower quality sound when said common wire is opened by said switch means when said waist is expanded, said lower quality sound being produced by partial cancellation of said left and right channels via said common ground connection whereby feedback as to the state of said abdominal muscles is given to said person only through said headphones.

2. A biofeedback system as in claim 1 where said buckle means further includes a switching member attached to said waistband mounted for linear in-and-out movement from said buckle and spring biased to tension said waistband and having a normal retracted switching position when said waist is contracted, and an expanded or extended opposite switching position when said waist is relaxed.

3. A biofeedback system as in claim 2 where said switching member includes a leaf spring mounted in said buckle means which is electrically connected to said audio source.

* * * * *